US006860458B1

(12) United States Patent
Pagano

(10) Patent No.: US 6,860,458 B1
(45) Date of Patent: Mar. 1, 2005

(54) BOOK HOLDER

(76) Inventor: Samuel Pagano, 1632 Squaw Creek, Girard, OH (US) 44420

( * ) Notice: Subject to any disclaimer, the term of this patent is extended or adjusted under 35 U.S.C. 154(b) by 0 days.

(21) Appl. No.: 09/917,520

(22) Filed: Jul. 30, 2001

(51) Int. Cl.[7] ..... A47B 19/00
(52) U.S. Cl. ..... 248/441.1; 248/451; 248/174
(58) Field of Search ..... 248/451, 452, 248/446, 448, 449, 149, 152, 174, 441.1, 455, 457

(56) References Cited

U.S. PATENT DOCUMENTS

| | | | | | |
|---|---|---|---|---|---|
| 456,089 | A | * | 7/1891 | Harrison | 190/10 |
| 1,899,404 | A | | 2/1933 | White | |
| 2,156,225 | A | | 4/1939 | O'Meara | |
| 2,441,932 | A | | 5/1948 | Curry | |
| 3,043,047 | A | * | 7/1962 | La Fleur | 248/220.41 |
| D219,757 | S | * | 1/1971 | Pagano | D19/91 |
| 3,813,075 | A | * | 5/1974 | Capper | 248/451 |
| 4,116,414 | A | | 9/1978 | Robertson | |
| 4,416,414 | A | | 11/1983 | Edgerton | |
| 4,470,571 | A | * | 9/1984 | Hartman | 248/452 |
| 4,496,127 | A | * | 1/1985 | Nelson | 211/43 |
| 4,531,642 | A | * | 7/1985 | Racich | 211/42 |
| 4,712,760 | A | | 12/1987 | Winter | |
| 4,787,595 | A | * | 11/1988 | Hegarty | 248/447 |
| 4,925,146 | A | * | 5/1990 | Hegarty | 248/447 |
| 5,052,650 | A | | 10/1991 | Beile et al. | |
| 5,060,904 | A | * | 10/1991 | Hegarty | 248/447 |
| D327,172 | S | * | 6/1992 | Pagano | 248/460 |
| 5,154,391 | A | * | 10/1992 | Hegarty | 248/205.2 |
| 5,230,535 | A | * | 7/1993 | Figlenski | 248/441.1 |
| 5,351,927 | A | * | 10/1994 | Howell | 16/18 R |
| 5,356,109 | A | * | 10/1994 | Biasini | 248/441.1 |
| D366,568 | S | | 1/1996 | Pagano | |
| 5,634,623 | A | * | 6/1997 | Hoijtink | 248/448 |
| D381,212 | S | | 7/1997 | Pagano | |
| 5,855,329 | A | | 1/1999 | Pagano | |
| 5,979,858 | A | | 11/1999 | Bronson | |
| 6,367,760 | B1 | * | 4/2002 | Pagano | 248/451 |
| 6,425,567 | B2 | * | 7/2002 | Schutze | 248/452 |

* cited by examiner

*Primary Examiner*—Kimberly Wood
*Assistant Examiner*—Naschica S. Morrison
(74) *Attorney, Agent, or Firm*—Harpman & Harpman

(57) ABSTRACT

A convertible book holder for holding and positioning books and documents. The book holder includes a freestanding document display and support portion with an integral resilient clip and independent paper engagement clip. An adaptive enlarged L-shaped document support is removably secured over the freestanding support portion to enhance the holding capabilities for larger and oversize text of instructional type books.

8 Claims, 6 Drawing Sheets

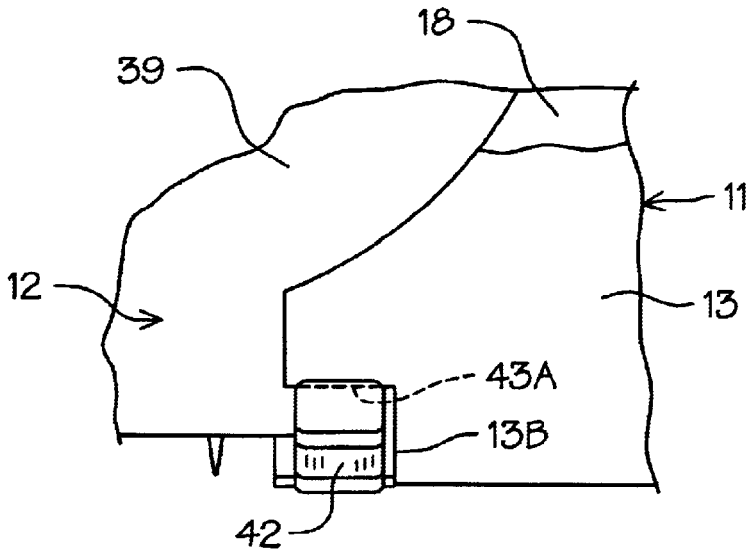
FIG. 6
FIG. 7
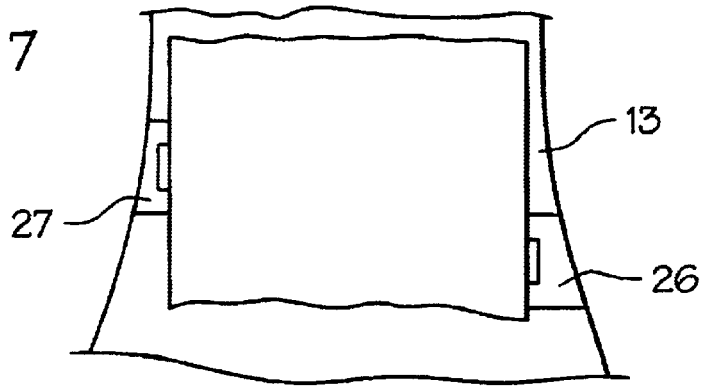

BOOK HOLDER

BACKGROUND OF THE INVENTION

1. Technical Field

This device relates to book and copy holders that are used to hold and retain different size copy and books for independent hands free use.

2. Description of Prior Art

Prior art devices of this type have relied on a variety of different constructions for supporting a book or papers in an upstanding readable position without user assistance. Heretofore, it was required that the user uses at least one hand to hold the book open in an upright position for use. Hardback books could be propped up by leaning on some article and non-rigid publications such as workbooks, for example, would require more support. Accordingly, a number of book and page holders have been developed to address this problem.

Typically, prior art book holders of this type have a support frame with attachment straps, hooks or clamps to hold the books on the support stand in open position. Such devices can be seen in U.S. Pat. Nos. 1,899,404, 2,156,225, 2,441,932, 4,416,414, 4,712,760, 5,052,650 and 5,979,858. Applicant's own U.S. Pat. No. D366,568, D381,212, and U.S. Pat. No. 5,855,392.

In U.S. Pat. No. 1,899,404, a book holder and table can be seen having a book support platform pivotally secured to an adjustable frame stand with a center engagement clip and a pair of adjustable leaf retainers.

U.S. Pat. No. 5,979,858 is directed to a copyholder having an L-shaped free stand copy rest with an upright support panel. A copy engagement clip is positioned over the upper edge of the panel with legs that apply pressure towards one another for engaging the copy against the support panel.

Applicant's U.S. Pat. Nos. D366,568 and D381,212 disclose designs having freestanding book holder in D366,568 with an engagement slot and a holder adapter in D381,212 that has an enlarged L-shaped support panel to be interengaged with applicant's book holder of U.S. Pat. No. D366,568.

In U.S. Pat. No. 5,855,329 applicant's book holder is shown having multiple document engagement clips that are engageable from the main support surface.

SUMMARY OF THE INVENTION

A book holder of the present invention for supporting and displaying a variety of different size books and documents in an upright usable position. The holder includes a freestanding leg support adapted to lockingly engage on an elongated angled support surface thereon. The leg support has bi-lateral offset braces to allow for vertical nesting of multiple holders for storage.

DESCRIPTION OF THE DRAWINGS

FIG. 6 is an elongated partial rear elevational view of the registration as seen in FIG. 5;

FIG. 7 is an enlarged partial rear elevational view of interengaging portions of the book holder when in stacked stored position.

FIG. 9. is an enlarged partial side elevaional view of the bee standing portion illustrating the resilient clip in solid and broken lines extending tiered from.

DESCRIPTION OF THE PREFERRED EMBODIMENT

Figure 1:
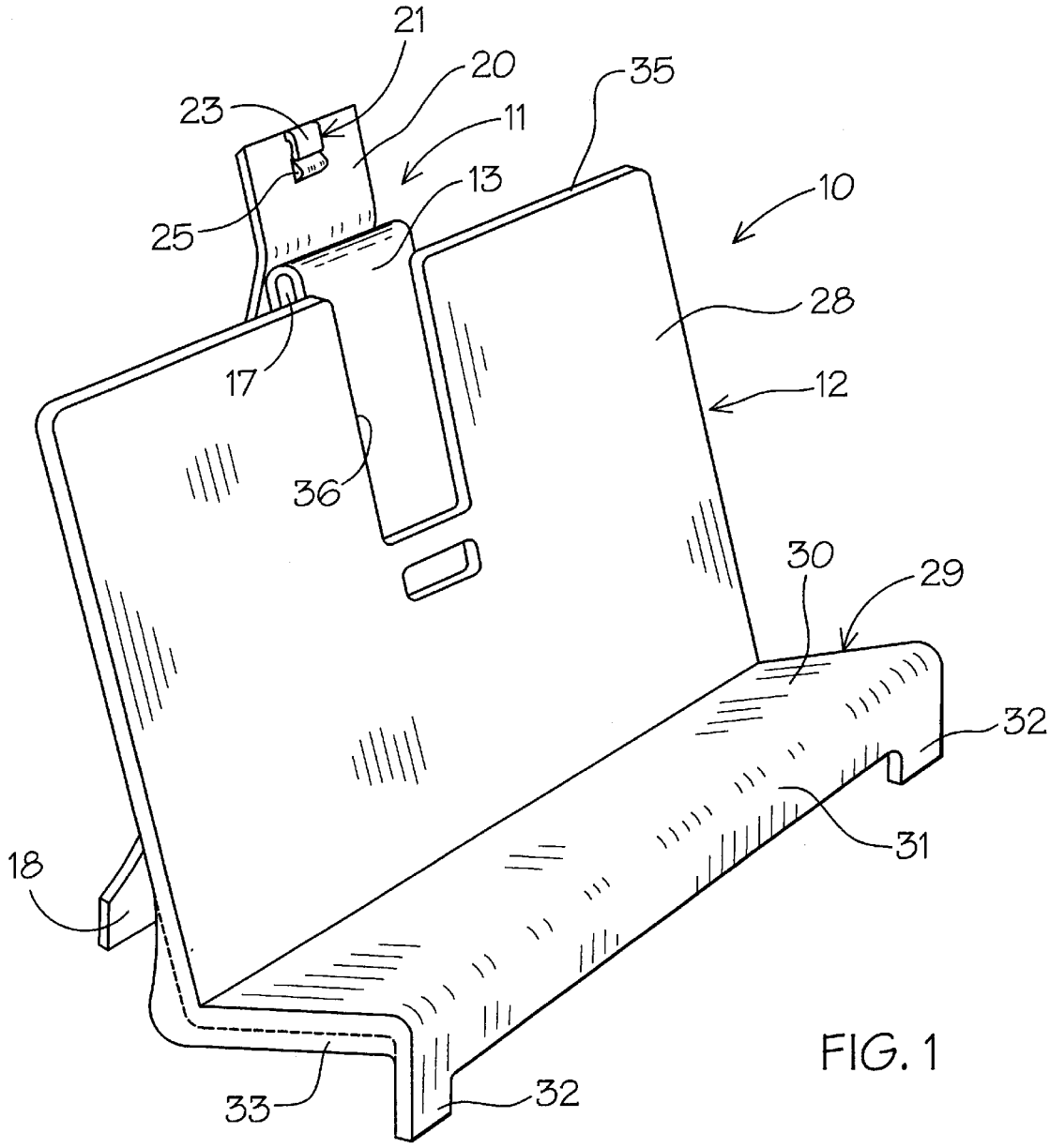
FIG. 1 is a perspective view of the book holder of the invention.
Figure 2:
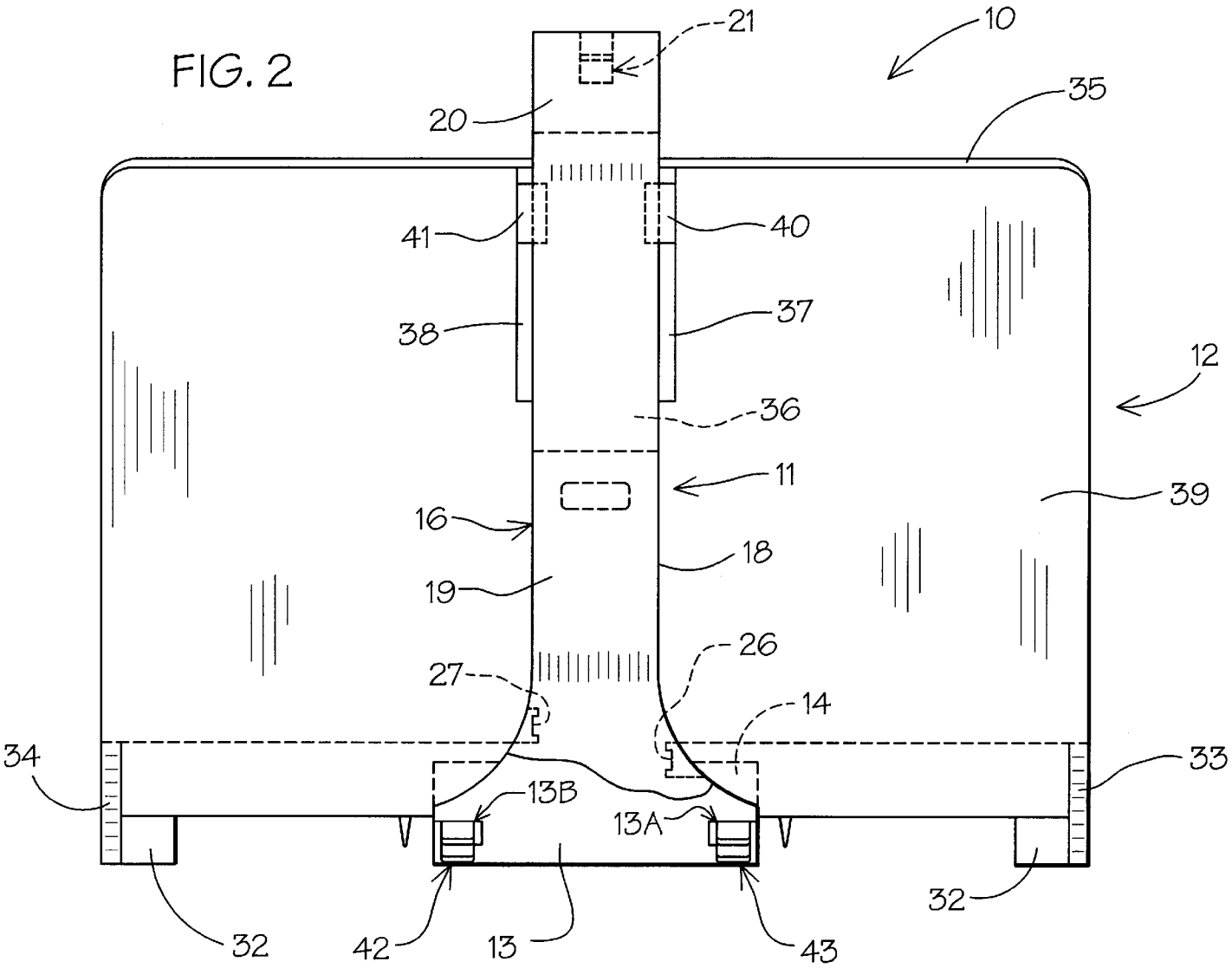
FIG. 2 is a rear elevational view of the book holder as seen in FIG. 1.
Figure 3:
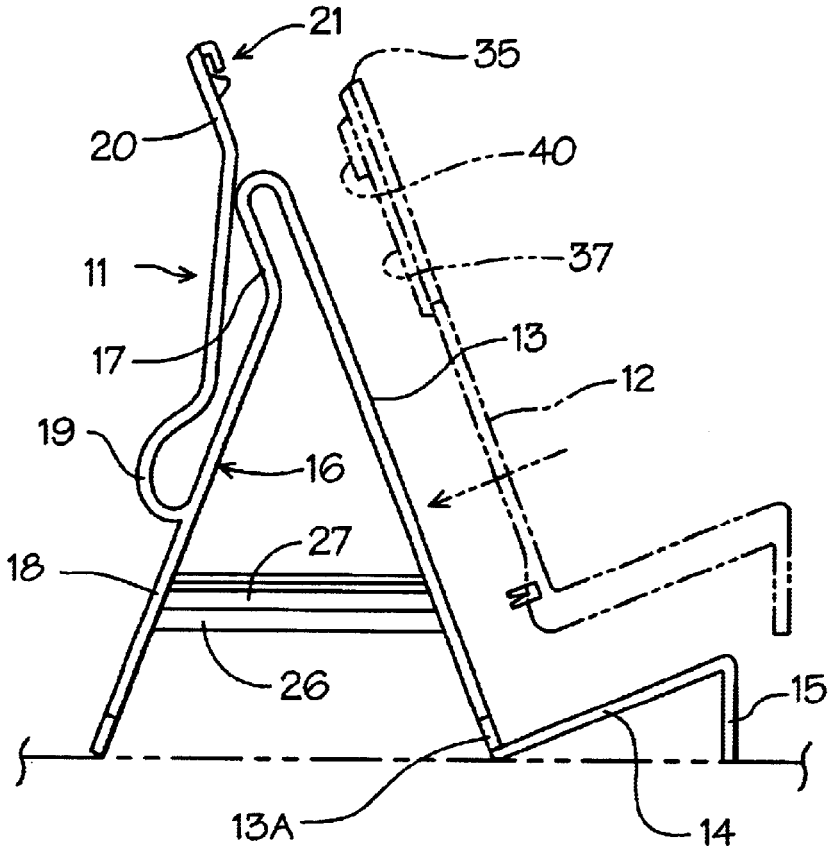
FIG. 3 is a side elevational view of the free standing support portion of the book holder with the elongated support surface shown in broken lines as to be engaged thereon.
Figure 4:
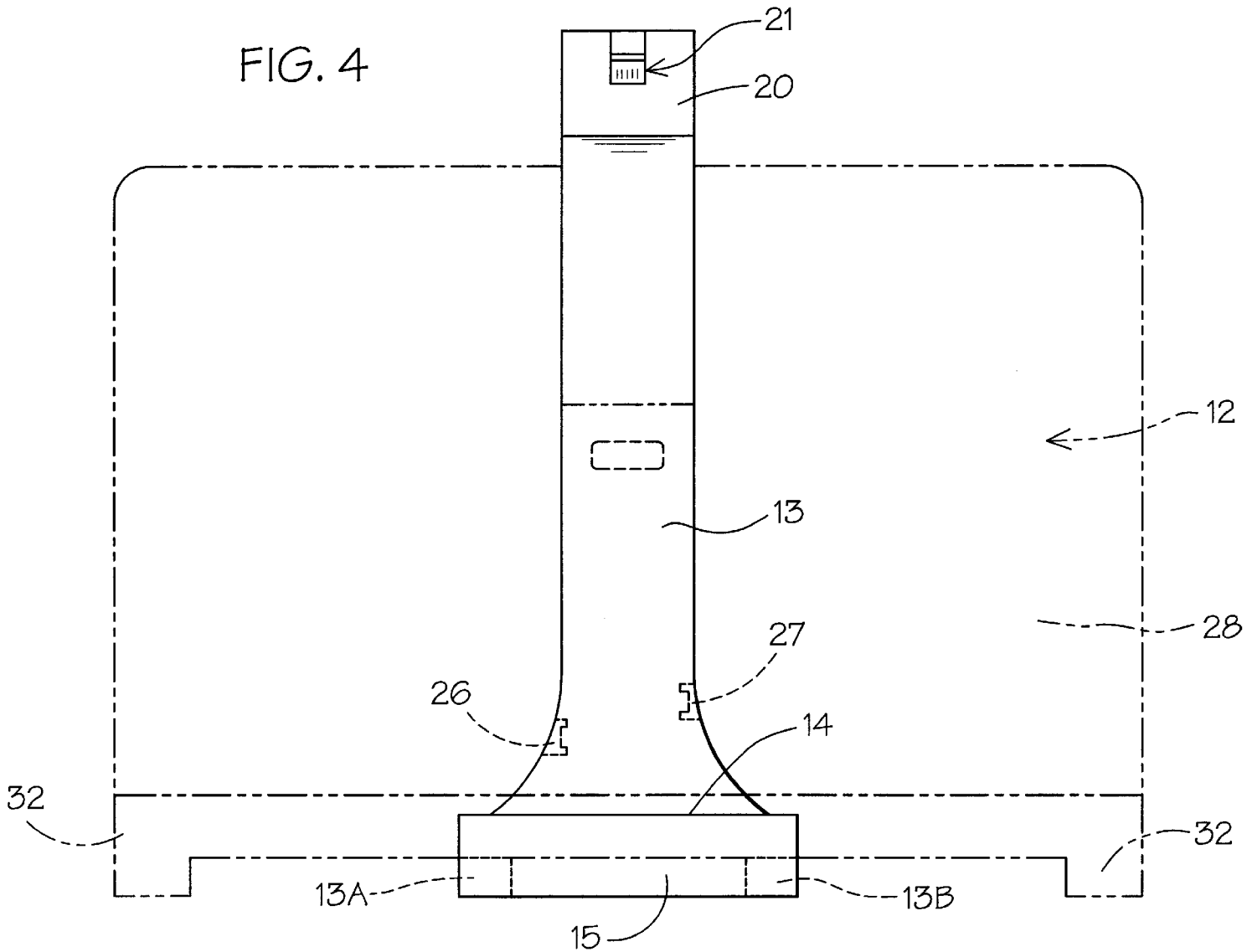
FIG. 4 is a front elevational view of the freestanding support with the elongated support surface indicated in broken lines.
Figure 8:
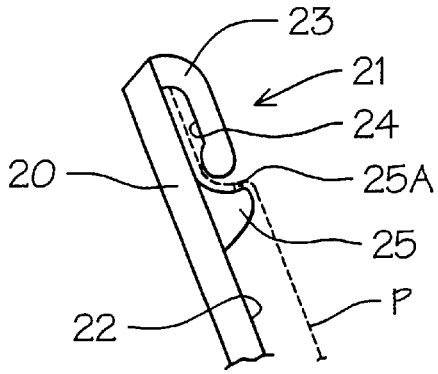
FIG. 8 is an enlarged partial side elevational view of the free standing portion illustrating deflection of the resilient areas in broken lines.
Figure 9:
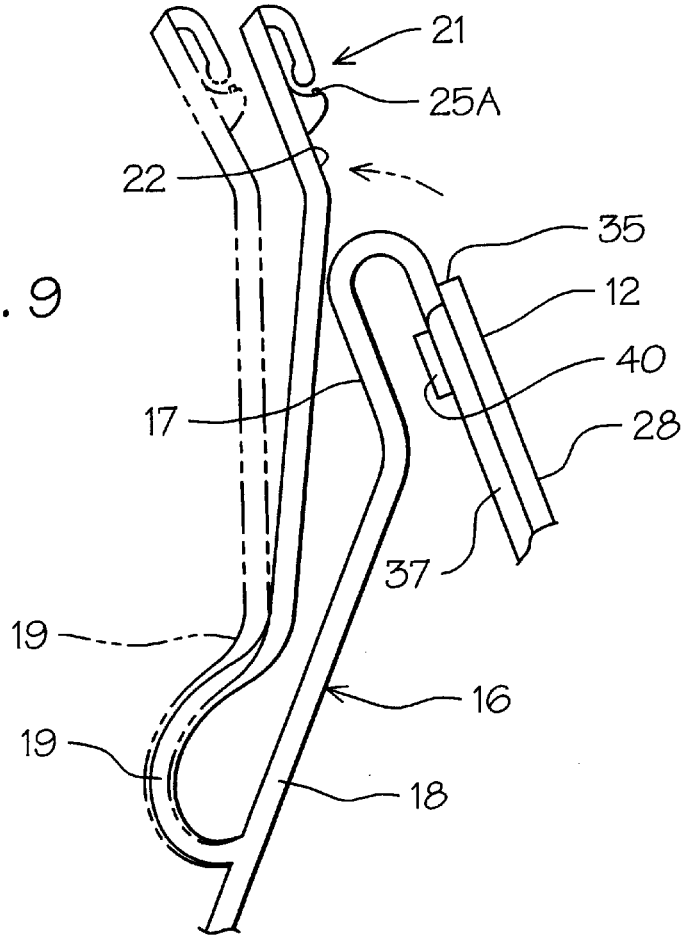

Referring now to FIGS. 1 and 2 of the drawings, a book holder 10 of the invention can be seen having a free standing support portion 11 and a removable enlarged book support portion 12. The freestanding support portion 11 has a document engagement surface 13 having an integral angular base 14 with a front wall foot 15 extending vertically from the base 14. A pair of longitudinally spaced registration engagement notches 13A and 13B are formed within the engagement surface 13 adjacent the base 14 as best seen in FIGS. 3 and 4 of the drawings. A support leg portion 16 extends integrally from the end of the document engagement surface 13 having a return portion 17 in spaced parallel relation thereto. A ground engagement extension 18 extends integrally from the return portion 17 in oppositely disposed angular relation to said engagement surface 13. A resilient clip 19 extends integrally from the ground engagement extension 18 with an upstanding-inclined surface 20 providing engaging force against the return portion 17. A two-part page-retaining clip fitting 21 is formed on an angular end surface 22 of the inclined surface 20 as best seen in FIGS. 8 and 9 of the drawings.

The page-retaining clip 21 has an upper portion 23 that extends in spaced parallel relation to the surface 22. The upper portion 23 is contoured on its inner surface 24. A paper engagement spacing lug 25 is in vertical spaced relation there below. An upstanding paper engagement ridge 25A extends transversely on the surface of the lug 25.

A pair of brackets 26 and 27 interconnects the engagement surface 13 and the ground engagement extension 18. It will be seen that the respective brackets 26 and 27 are staggered vertically to afford stackability of multiple units for storage as will be illustrated in FIG. 7 of the drawings as is well understood by those skilled in the art.

The brackets 26 and 27 along with the respective leg 16 and engagement .surface 13 form a structural triangle of the freestanding support portion 11 as best seen in FIG. 3 of the drawings.

Referring now to FIGS. 1–4 of the drawings, the enlarged angle book support portion 12 can be seen having an inclined upper surface 28 with a base 29 extending angularly there from. The base 29 has an upper engagement surface 30 with a vertically disposed front 31 portion of which form a pair of oppositely disposed legs 32. The upper surface 30 of the base 29 and front surface 31 have respective interconnecting sidewall surfaces 33 and 34.

Referring now to FIG. 2 of the drawings, the book support portion 12 has a top perimeter edge 35 with a notch at 36 extending inwardly therefrom. A pair of guide bars 37 and 38 extend from a backside 39 of the book support portion 12 in spaced parallel relation to said notch 36. Engagement tabs 40 and 41 extend from portions of said respective guide bars 37 and 38 for registration with the document engagement surface 13 when attached thereto as will be discussed in greater detail hereinafter.

Figure 5:
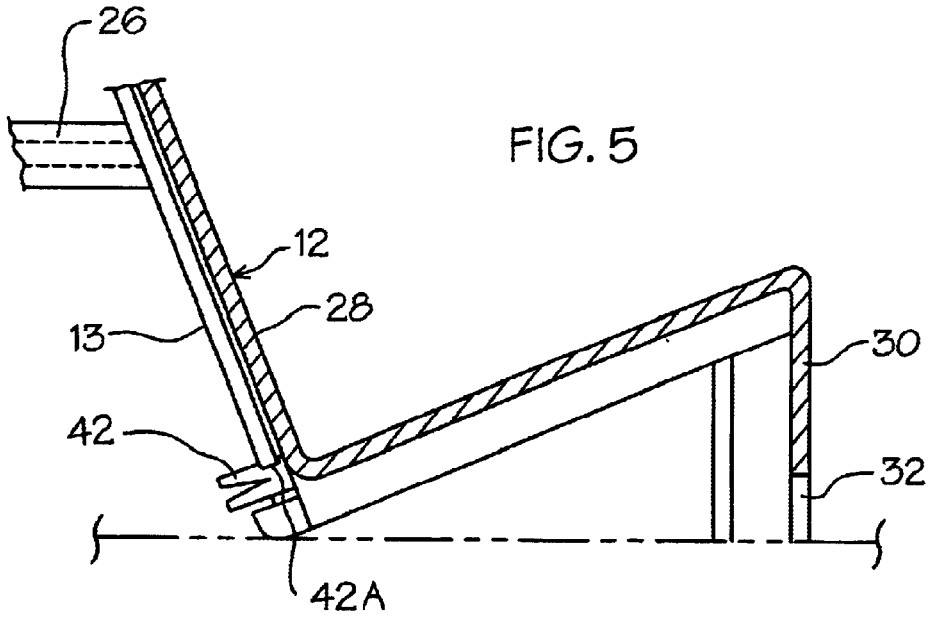
FIG. 5 is an enlarged partial cross-sectional view of the registration between the freestanding support and elongated support surface.

A pair of fastening lugs 42 and 43 extend integrally from the backside 39 of the book support portion 12 as best seen in FIGS. 2, 3, 5 and 6 of the drawings. Each of the lugs 42 and 43 have a recessed registration area at 42A and 43A extending transversely across their respective upper surfaces. Accordingly, the lugs 42 and 43 are registerable within the respective notches 13A and 13B as best seen in FIGS. 5 and 6 of the drawings.

It will be noted that the lugs 42 and 43 are frictionally engaged on their recessed areas 42A and 43A by the notched surface of the document engagement surface 13 securely holding the book support portion 12 thereto.

It will be evident from the above description that the free standing support portion 11 also can be used independently to hold single sheet documents and small books and the like by placement on the L-shaped document engagement surface 13. Alternately the enlarged support book portion 12 can be attached thereto as hereinbefore described to provide a larger book and document support area while still maintaining a single sheet (P) holding capability afforded by the page retaining clip fitting 21 as seen in FIG. 8 in broken lines and engagement of book portions (not shown) by the resilient portion 19 as hereinbefore described.

Once attached, the enlarged book supporfing portion 12 can easily be removed by applying pressure between the inside of the front surface 31 and front wall foot 15 as indicated by broken line arrow in FIG. 5 of the drawings.

Having thus described my invention, it will be apparent to those skilled in the art that various changes and modifications may be made therein without departing from the spirit of the invention.

Therefore I claim:

1. A book holder comprises in combination;

a freestanding portion and a book support portion removably secured thereto;

said Standing portion having a planar document engagement surface with an integral angular extending base extending there from and an angularly extending leg pornon;

a resilient cip integrally extending from said leg portion;

said resilient dip having an upstanding inclined surface there above;

a paper retaining clip extending from said upstanding inclined surface in spaced relation to said planar document engagement surface, said paper retaining clip having an elongated body member with contoured a inner surface and an engagement lug in spaced relation to said contoured surface;

a pair of spaced independent horizontal brackets that are vertically offset from each other extending between said leg portion and said planar document engagement surface;

said book support portion comprises:

a lanar inclined upper support surface with an integral document support base extending at a right angle there from having a front wall surface angularly extending from said document support base;

oppositely disposed bifurcated fixation lugs extending from the intersection of said planar inclined upper support surface and said integral document support base of said book support portion for selective registration within notches in said planar document engagement surface of said free standing portion.

2. The book holder set forth in claim 1 wherein said front wall surface has a pair of integral oppositely disposed feet extending there from.

3. The book holder set forth in claim 1 wherein said planar inclined upper support surface is substantially flat having a notch extending inwardly from a top perimeter edge thereof.

4. The book holder set forth in claim 3 wherein said notch in said upper support surface has a pair of parallel spaced guide bas adjacent said notch, and means for selective engagement of said planar document engagement surface therewith.

5. The book holder set forth in claim 4 wherein said means for selective engagement of said planar document engagement surface comprises locking tabs extending from a portion of said guide bars, and overlying said notch in spaced parallel relation to one another.

6. A book holder comprsing;

freestanding portion and a book support portion removably secured thereto;

said freestanding portion having an inclined planar document engagement surface with an interconnected angularly disposed document support base and an angularly extending leg portion;

a resilient clip integrally extending from said leg portion;

said resilien clip having an upstanding inclined surface there above;

a paper retainer clip extending from said resilient clip, brackets extending between said leg portion and inclined planar document engagement surface in verticals paced relation to each other;

said book support portion comprises;

an upper support surface having a notch extending inwardly from a top perimeter edge thereof, a pair of parallel opposited disposed guide bars adjacent said notch, locking tabs extending from a portion of said guide bars overlying said notch in spaced patallel relation to one another, an integral base extending from the upper support surface having a font leg surface, locking fixtures extending from said book support portion for selective registration on said inclined document engagement surfaces.

7. The book holder set forth in claim 6 wherein said locking; tabs comprise:

a pair of longitudinally spaced lugs extending from the intersection of said upper support surface and integral base.

8. The book holder set forth in claim 6 wherein said inclined planar document engagement surface of said free standing portion has a pair of longitudinally spaced locking registration notches within.

* * * * *